US005746122A

United States Patent [19]

Gietz et al.

[11] Patent Number: 5,746,122

[45] Date of Patent: May 5, 1998

[54] EMBOSSING MACHINE

[75] Inventors: Hanspeter Gietz, Gossau; Manfred Rösli, Herisau; Heinz Bänziger, Gossau, all of Switzerland

[73] Assignee: Maschinenfabrik Gietz AG, Gossau, Switzerland

[21] Appl. No.: 642,438

[22] Filed: May 3, 1996

[30] Foreign Application Priority Data

May 4, 1995 [CH] Switzerland ..... 01279/95

[51] Int. Cl.[6] ..... B30B 15/14

[52] U.S. Cl. ..... 100/43; 100/50; 100/53; 100/99; 100/257; 100/286; 100/319

[58] Field of Search ..... 100/43, 48, 50, 100/53, 99, 257, 285, 286, 319, 320, 326, 101

[56] References Cited

U.S. PATENT DOCUMENTS

| | | | |
|---|---|---|---|
| 3,889,515 | 6/1975 | Grombka | 100/257 |
| 4,587,725 | 5/1986 | Ogawa et al. | 100/257 |
| 5,119,311 | 6/1992 | Gold et al. | 100/99 |
| 5,231,923 | 8/1993 | Ohta et al. | 100/320 |
| 5,297,478 | 3/1994 | Jartyn et al. | 100/257 |
| 5,379,688 | 1/1995 | Ishii . | |
| 5,491,647 | 2/1996 | O'Brien et al. | 100/99 |
| 5,558,015 | 9/1996 | Miyashita et al. | 100/320 |
| 5,578,159 | 11/1996 | Miyashita et al. | 100/320 |

FOREIGN PATENT DOCUMENTS

| | | | |
|---|---|---|---|
| 0151198 | 8/1985 | European Pat. Off. | 100/43 |
| 0 367 035 | 5/1990 | European Pat. Off. . | |
| 0596697 | 5/1994 | European Pat. Off. | 100/99 |
| 3241063 | 5/1984 | Germany | 100/43 |
| 63-281800 | 11/1988 | Japan | 100/53 |
| 6-55300 | 3/1994 | Japan | 100/99 |

*Primary Examiner*—Stephen F. Gerrity
*Attorney, Agent, or Firm*—Walter C. Farley

[57] ABSTRACT

The embossing or blocking and punching machine with a machine control (2) has several pressure sensors (S1 to S4) for measuring compressive forces X arranged around the center Z of the blocking surface F. A positioning device (10) with a displacement drive (20) and associated motor control (21) is connected to a pressure control program (30) with compressive force control functions (REG), with which is associated a control and display unit (40). Thus, a precise, automatic constant control of the optimum operating pressure (XA) can take place and a constant, maximum embossing or printing quality is achieved.

11 Claims, 5 Drawing Sheets

EMBOSSING MACHINE

The invention relates to an embossing machine .

BACKGROUND OF THE INVENTION

With machines such as embossing, foil embossing, blocking, die cutting or punching machines, compressive force measurements are usually only known at one point of the machine and outside the embossing or blocking surface. This requires complicated calculations as a function of the position of the dies or blocks for estimating the compressive forces on the blocking image surface. In addition, these force measurements are imprecise and unreliable. Influences, which modify the operating pressure and therefore deteriorate the embossing or printing quality, can consequently not be easily determined and their change during an operating process is even less compensated. Non-uniform pressure distributions on the blocking image surface cannot be detected.

SUMMARY OF THE INVENTION

It is therefore an object of the present invention to create an embossing and punching machine which permits precise determination of the compressive forces and therefore also the setting of an optimum blocking or printing quality and which in particular can bring about maximum compensation of the negative influences and changes during operation, so that a constant, maximum quality is achieved.

This object is achieved by an embossing and punching machine according to the invention. The arrangement of several pressure sensors around the blocking surface permits an accurate compressive force determination and monitoring. The combination with the positioning device with controlled displacement drive, with the pressure control program and the display means makes it possible to set optimum operating pressures and to keep them in a constant, optimum form during operation, even when negative influences occur.

Advantageous further features of the invention further automate, improve and make more simple and reliable their functions. Particular advantages occur in the automatic performance of the working processes such as touching, operating pressure being kept constant and the performance of virtually free programmable desired pressure value runs. The machine according to the invention makes it possible to maintain safety and limiting values and the determination of non-uniform, eccentric pressure distributions on the blocking surface. However, in particular, the different variable influences on the operating pressure and which deteriorate the quality, e.g. due to thermal influences or increasing, permanent deformation or thickness changes of the make-ready and due to paper thickness fluctuations, are largely compensated. This permits a maximum, constant blocking or embossing quality with minimum control expenditure and maximum safety and reliability.

BRIEF DESCRIPTION OF THE DRAWINGS

The invention is described in greater detail hereinafter relative to the drawings, wherein:

FIG. 1*b*, 2 are schematic plan views, partly in section, of the machine of

FIG. 1*a* showing arrangements of compressive force sensors and eccentric loads.

DESCRIPTION OF THE PREFERRED EMBODIMENTS

Figure 1A:
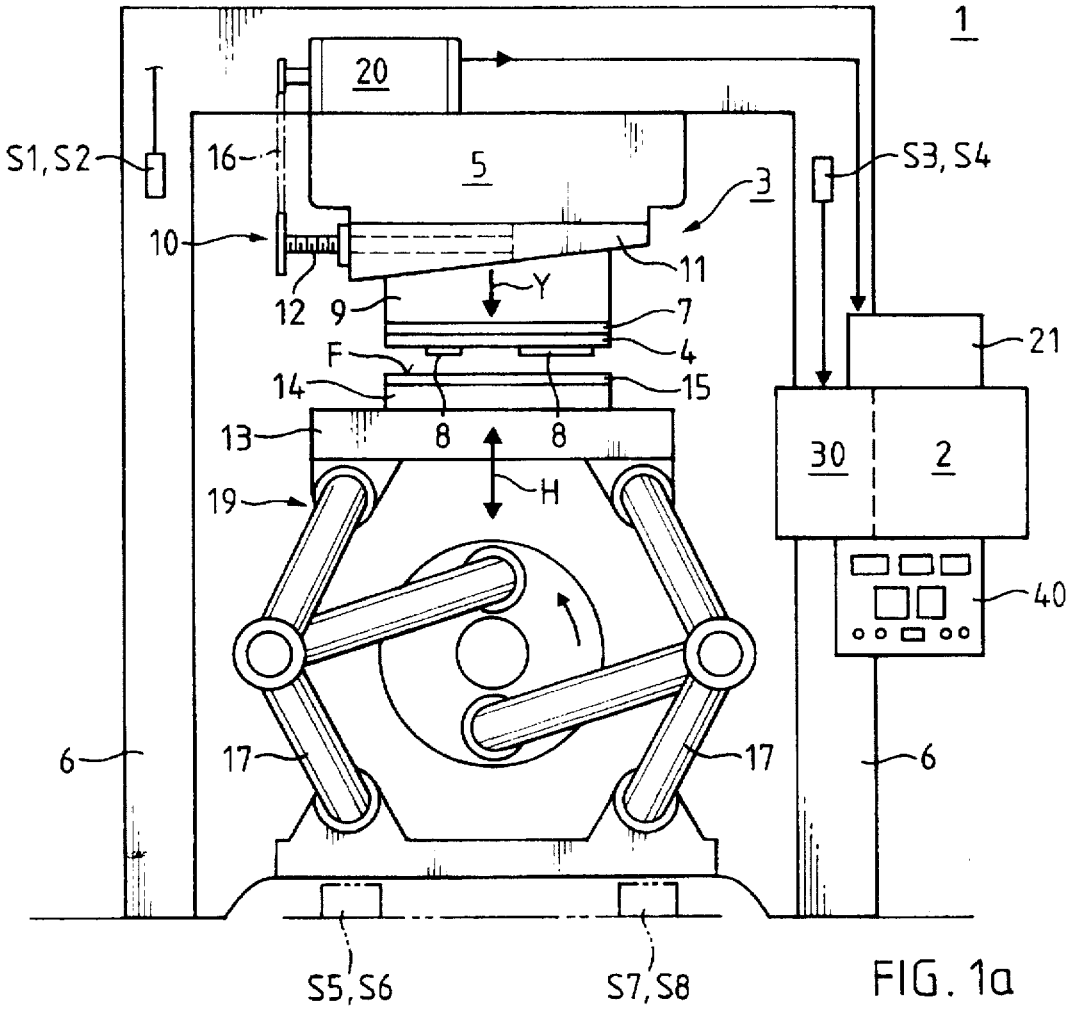
FIG. 1*a* is a side elevation of a machine according to the invention.

FIG. 1*a* shows in side view an embossing or blocking and punching machine 1 according to the invention with a press top 3, which is held by lateral supports 6, with an upper support 5, a positioning or displacement device 10 and a die block 9. The block 9 carries a tool or block plate 4 with a heating means 7, which e.g. comprises several, individually regulatable heating zones.

A press bottom 19 has in this case a toggle mechanism with four toggle pairs 17, which move a platen 13 up and down through a travel H of e.g. 80 mm. On the platen 13 is fitted a back-pressure or make-ready plate 14, whose surface forms the embossing or blocking surface F (i.e. the maximum usable blocking surface). On the block plate 4 are fitted dies or blocks 8, whose surfaces define the blocking image surface FC (see also FIGS. 1*b* and 2). On the make-ready plate 14 is placed a make-ready 15 adapted to the blocks 8 and which e.g. comprises a 1 to 2 mm thick, fiber-reinforced plastic plate of hard laminate, e.g. Pertinax, or less hard material such as pressboard or unreinforced plastic. The material and layer thickness are adapted to the blocks and the blocking material. By local shimming of thin paper layers with a thickness of e.g. 20 μm, the make-ready is set in known manner to the optimum blocking quality. The optimum blocking pressure or blocking compressive force X is set by the displacement of the positioning device 10 in the Y-direction. The drive 20 is constituted by a controlled adjusting motor, e.g. a servomotor with an incremental generator and an associated motor control 21. The displacement Y takes place by means of a transmission 16 driving a spindle 12, which moves a displacement wedge 11. The maximum possible displacement range of Y is e.g. 4 mm, which makes it possible to compensate different layer thicknesses of the make-ready and the blocking material.

Figure 1B:
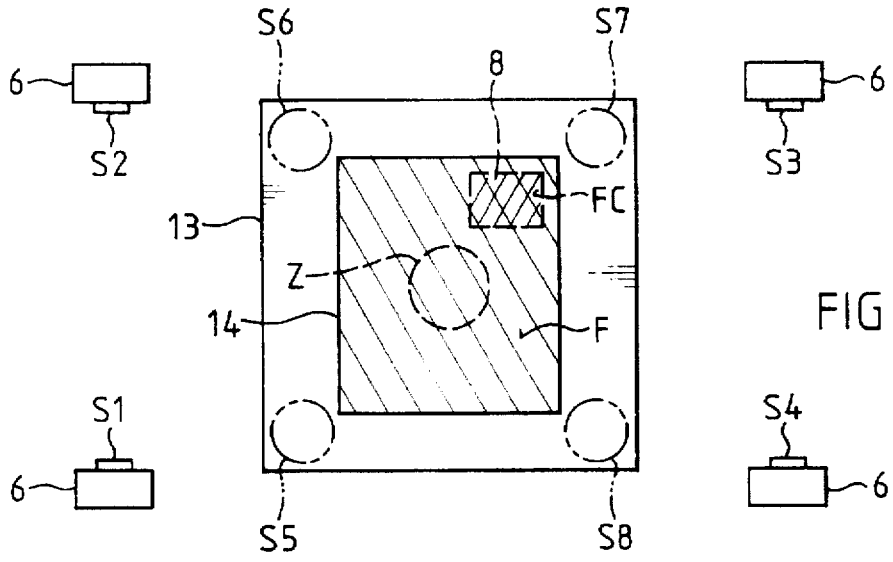

As is shown in FIG. 1*b* as a partial representation of the machine 1 from above, several compressive force sensors S1 to S4 or S5 to S8 are arranged around center Z of the blocking surface F of the plate 14. The compressive force measurement takes place e.g. by means of strain gauges or piezoelectric elements, which are fitted to suitable machine chassis elements subject to clearly detectable strains under loads. As an example there are strain gauges S1 to S4 fitted to lateral supports 6, which could also be fitted to the die block 9. The compressive forces can also be detected with pressure cells S5 to S8, which are e.g. arranged in the four corners in each case under a toggle 17, as shown in FIG. 1*a*. As a result of this rectangular arrangement of the force measuring sensors S1 to S4 or S5 to S8 around the center Z of the blocking surface F, it is possible to readily detect and monitor eccentric loads through the blocking image surface FC, i.e. through the position of the blocks 8.

Figure 2:
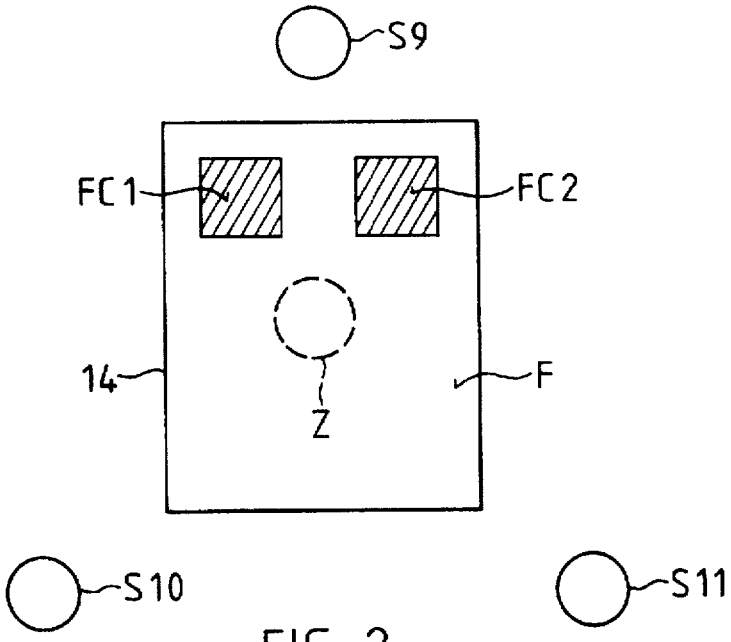

FIG. 2 shows a further example with a triangular arrangement of the sensors S9 to S11 and an eccentric arrangement of the blocks or blocking image surfaces FC1 and FC2, which give a greater loading on the side of the sensor S9. By detecting and monitoring non-uniform loads it is in particular possible to avoid press damage. Thus, with each individual sensor can be associated as the maximum permitted value a safety or security value XMi and the maintaining thereof is monitored. From the measured values of the sensors S1 to S4, i.e. from the partial compressive forces XSi (e.g. according to FIG. 1*a*) by superimposing the total compressive force X is determined: X=XS1+XS2 +XS3+ XS4. As the maximum permitted values for a given machine is e.g. fixed in set manner a safety value XM=1500 kN and a safety value XMi=450 kN for each individual sensor. In operation, all the safety values XM and XMi must always be respected.

Figure 3:
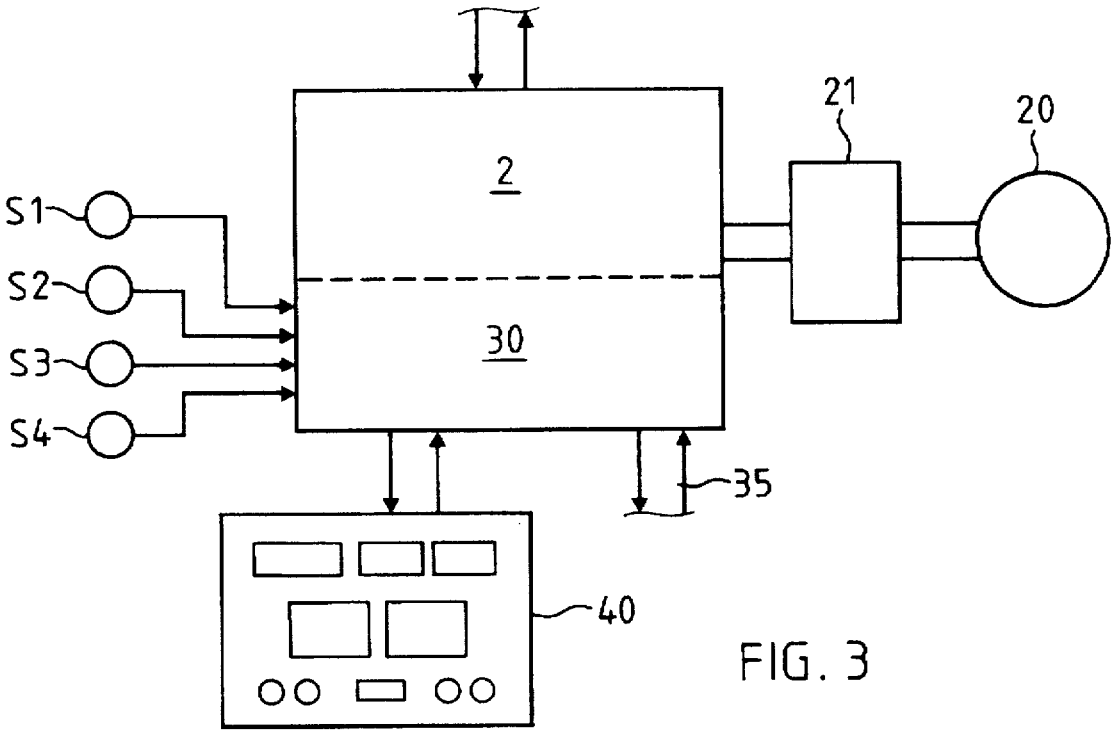
FIG. 3 is a schematic block circuit diagram of the machine.

FIG. 3 shows a circuit diagram of the machine according to the invention with compressive force sensors S1 to S4, which are connected to the pressure control 30 of the machine control 2. The positioning servomotor 20 with motor control 21 is also connected to the machine control 2 and the pressure control 30. There is a bidirectional communication with the controls 30 and 2 at the display unit 40, which is e.g. constructed as a touch screen. A further output 35 can be provided for bidirectional connection with an external computer, e.g. with a PC, for outputting operating data and inputting additional functions.

Figure 4:
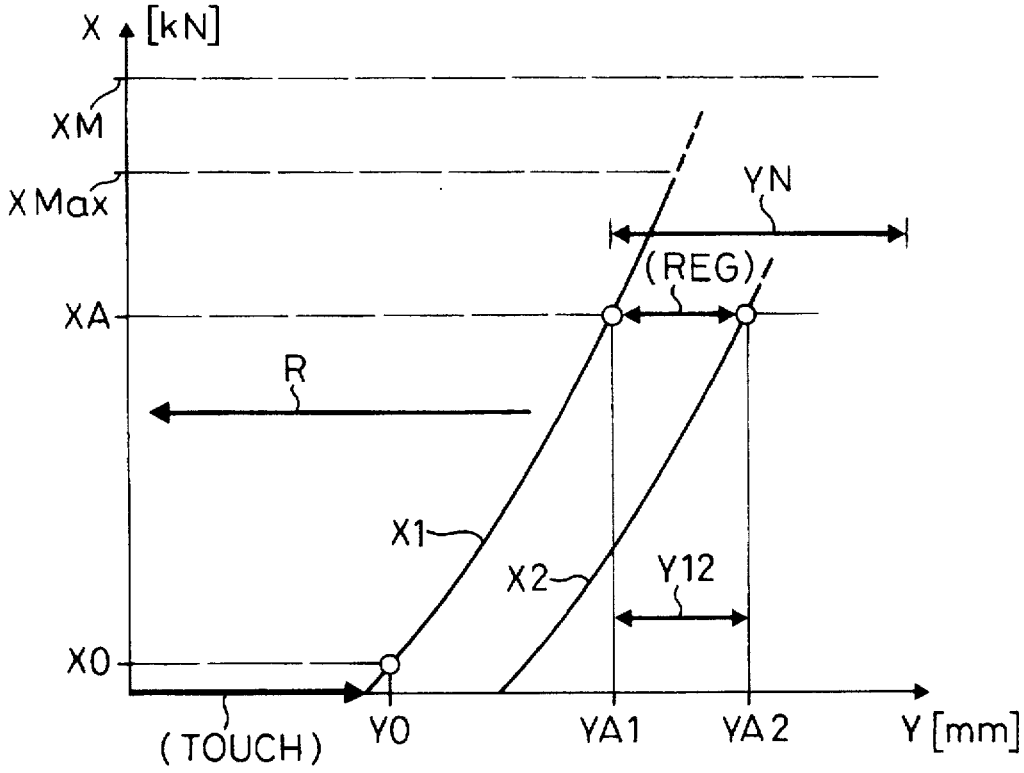
FIG. 4 is a Cartesian diagram of compressive force-displacement characteristics X(Y).

FIG. 4 shows a characteristic X1(Y) valid for a particular make-ready, i.e. the compressive force X1 produced on the blocking material as a function of the displacement Y through the press. This characteristic can be automatically run and recorded, if the following function is e.g. inputted into the control program: linearly increase as a function of time the displacement Y until the compressive force value X1 has reached a given value Xmax.

This characteristic X(Y) is naturally dependent on the blocks and the make-ready (material type, thickness and size), i.e. it characterizes this make-ready and this specific embossing or blocking process. During operation this characteristic X(Y) of a given make-ready gradually changes, e.g. from the curve X1(Y) in the initial state to the curve X2(Y) after a particular run time, because the make-ready becomes worn and increasingly compressed during a blocking operation. This must be compensated by a correspondingly larger displacement Y, in order to again reach the same compressive force value X, e.g. the operating value XA: from YA1 to YA2 with YA2=YA1+Y12. Thus, the die block 9 must be readjusted by the range Y12.

Other influences which can bring about a change or a displacement of the characteristics X(Y) will be discussed relative to FIG. 6.

Figure 5:
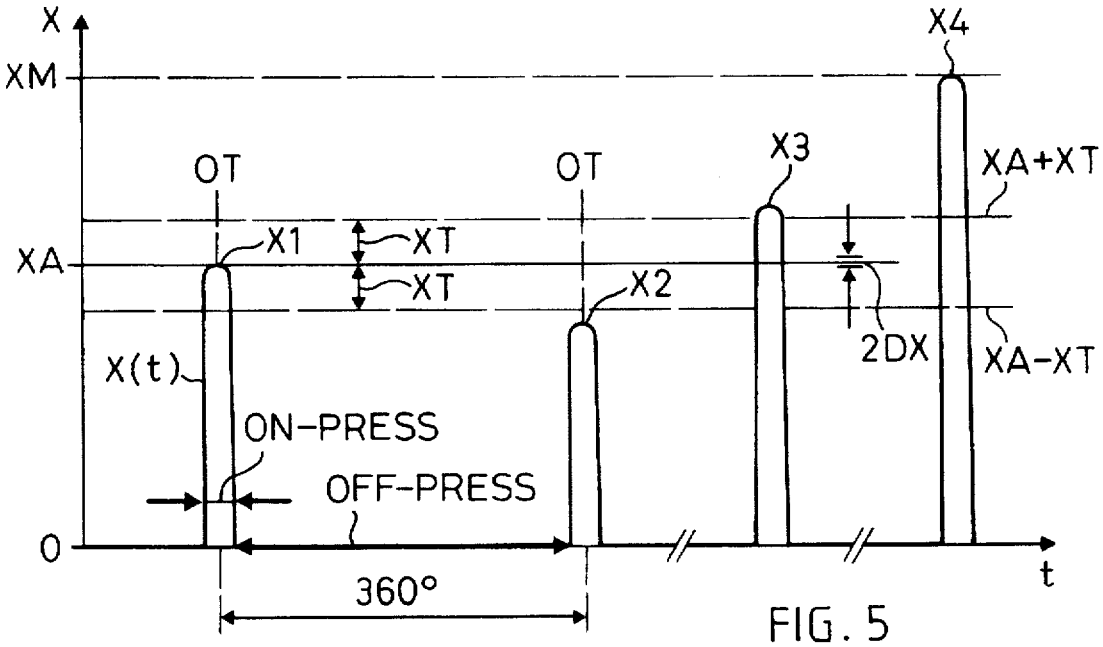
FIG. 5 is a diagram showing examples of different compressive force values.

FIG. 5 shows the distribution of the pressure measurement signals as a function of time t: X1(t). Over a machine cycle of 360°, during which the toggle press performs a stroke or travel H, only for approximately 20° to 25° is the press under pressure (on-pressure range). For the remaining time of 335° to 340° the press exerts no pressure (X=O, off-pressure range). The pressure distribution has a broad maximum in the upper dead center OT. The displacement in Y through the adjusting device 10 always takes place without (i.e. in the off-pressure range). During this time the zero points of the sensor values are also readjusted (balancing a zero point drift of the measurement signals, e.g. due to thermal influences on the sensors). Thus, during each press travel the effectively exerted compressive force X is determined as the difference of the measurement values between the upper dead center OT and the off-pressure range. A specific tolerance range can be provided and monitored for the said balancing of the zero point drift of the sensor measured signals: system limiting values of the zero point which, when exceeded, give rise to error messages.

The compressive force distributions X1, X2, X3, X4(t) shown as examples, corresponding to different displacement values Y1, Y2, Y3, Y4, illustrate different embossing or blocking cycles.

X1 corresponds to the operating value XA at which the optimum blocking or embossing quality is obtained. An adjustable and selectable tolerance value +XT, −XT is associated with this operating value XA. The curve with the compressive force value X2 is here below the tolerance range XA−XT and the value X3 is above the tolerance range XA+XT, the curve with the compressive force value X4 corresponding to the safety value XM, i.e. the maximum permitted pressure.

The tolerance value XT is e.g. adjustable between 10 and 100 kN. However, this tolerance range is only used if operation does not take place in the operating mode "REG"= operating value automatically kept constant, because there control takes place well within this tolerance range XT with a much smaller system deviation DX (cf. FIG. 7).

Figure 6:
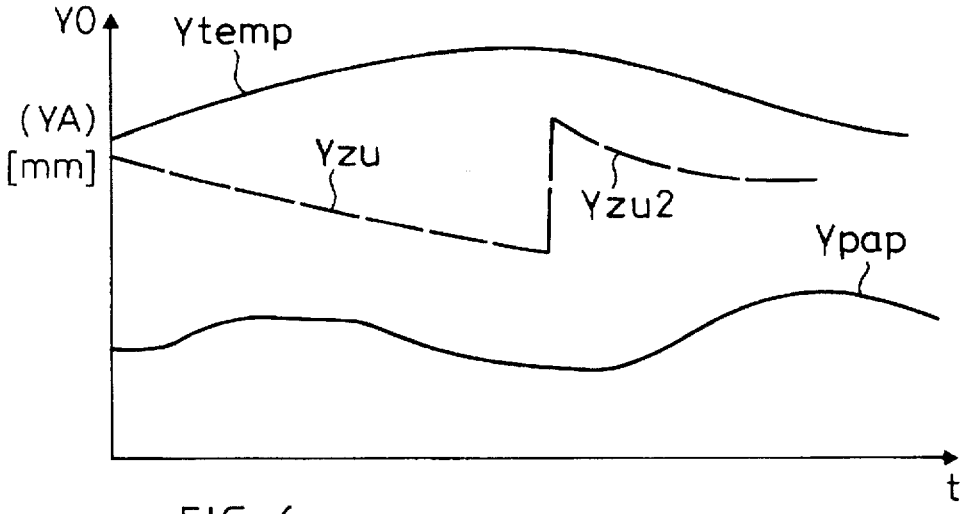
FIG. 6 is a diagram illustrating various influences on the compressive force-displacement characteristics.

FIG. 6 illustrates different influences, which bring about time changes of the characteristic Y(X) (FIG. 4) or changes to threshold values YO(t) and operating values YA(t) for given, constant compressive force values XO and XA: this is represented with the curves Ytemp, Yzu and Ypap.

On heating up of the machine different thermal expansions occur, which give rise to corresponding changes to the spacing between the block plate 4 and the make-ready plate 14, as is shown by the curve Ytemp.

Continuously progressing wear and constant compression of the make-ready 15 brings about e.g. a path corresponding to curve Yzu. If the make-ready is changed (and the Y-value readjusted), there is a displaced curve Yzu2.

A further influence on the displacement values YO or YA(t) result from paper thickness fluctuations, as illustrated by the curve Ypap. The superimposing of all these influences Ytemp, Yzu, Ypap, etc. finally gives the resultant, time overall change of the characteristic X(Y), which corresponds e.g. to curve X6(t) in FIG. 7.

The machine according to the invention permits the most varied operating modes. They are stored as functions in the pressure control program 30 and can be selected by means of the display unit 40 or can be externally inputted via the output 35. Therefore it is possible to input or reprogram the most varied operating parameters with respect to the blocking operation, as well as limiting values, tolerances, switching values and programmed desired value patterns (cf. FIG. 8).

An important example is the automatic performance of a "TOUCH" operating mode or function. For this purpose the press is brought into and stopped in the dead center OT. Then the pressure measurement takes place continuously and not cyclically as during normal machine operation in the "RUN" mode (cf. FIG. 5). In the position OT the adjusting device 10 is automatically displaced, i.e. Y is increased until a pressure rise is measured. When a minimum adjustable pressure threshold value XO is reached, the displacement Y is stopped and the corresponding YO, i.e. said position is stored. This is shown in FIG. 4. The pressure threshold is e.g. XO=5 to 10 kN, i.e. approximately 1% of the operating value XA.

A particularly important function "REG" is to keep automatically and precisely constant the operating value XA, i.e.

the optimum compressive force for maximum quality of a given print impression. For this purpose by varying the compressive force X firstly the operating value is determined, which gives an optimum embossing or blocking image. This value is defined and fixed as the operating value X=XA. Then the function "REG" is selected and the operating value XA is then kept automatically constant, i.e. within a narrow control difference DX.

This sequence e.g. takes place according to the following "REG" diagram:

When the pressure measurement has been set to "RUN", the "REG" key has been pressed and the Y-adjustment released, then the desired value Xsoll=XA is compared with the actual value=mean value Xm:

If the deviation Xm−XA is greater than the control difference DX, then there is a readjustment of Y by a readjustment step DY.

Additionally a check is made to establish whether the readjustment range YN has been exceeded and then eventually a signal is outputted and the machine is stopped.

This is followed by a new averaging Xm.

To avoid an unnecessary, perpetual controlling backwards and forwards, the actual value of the control is preferably constantly determined as the mean value Xm from the n last compressive force measurements. For example, n=5 is chosen, so that the mean value is Xm=⅕ of the sum of the last five measured values X.

The control difference DX is e.g. 5 to 10 kN and the control readjustment step DY is e.g. 1 to 2μ.

For the further monitoring of the blocking impression a readjustment range YN can be selected of e.g. YN=0.1 mm. As soon as the automatic tracking of Y reaches this value (i.e. e.g. YA1+YN in FIG. 4), then a signal is outputted and the machine eventually stopped. The operator can then decide whether he wishes to extend over and beyond this readjustment range YN, by giving a new, second readjustment range of e.g. 0.05 to 0.1 mm, or whether the make-ready is to be modified and restarted.

A further important safety function is obtained with the operating mode "automatic off-pressure". Here, the sheet entry into the press is monitored. If no entering sheet is detected, then the displacement device 10 is immediately moved back by e.g. 1 mm in direction −Y (according to arrow R in FIG. 4) before the next toggle press stroke takes place. This avoids the make-ready 15 embossing when no sheet is entering.

Figure 7:
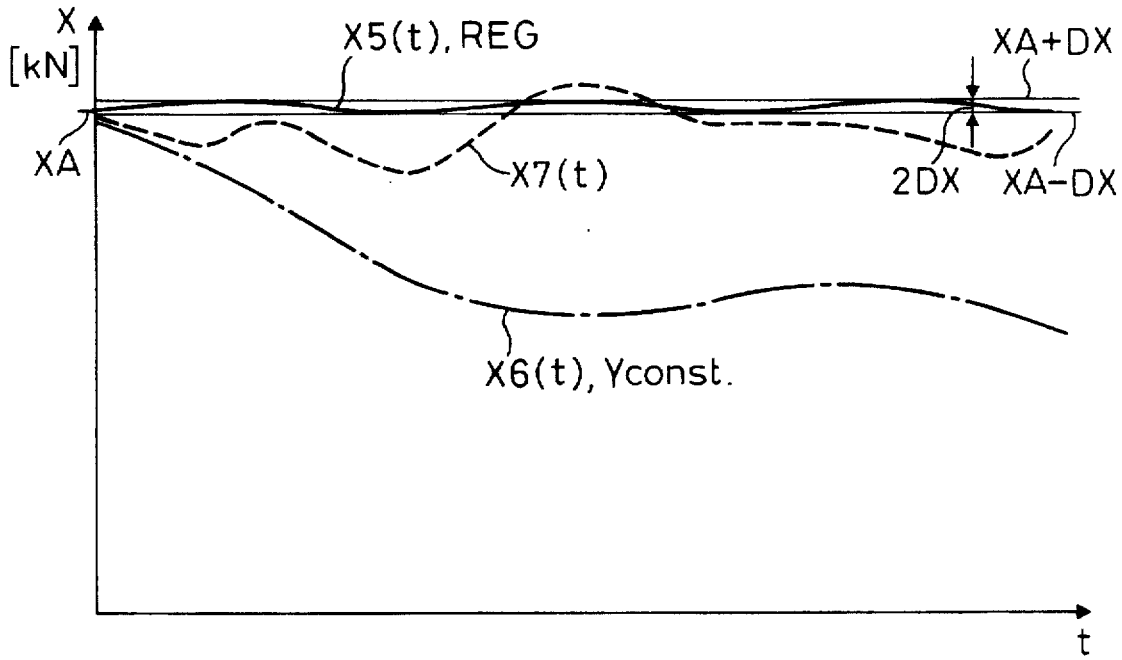
FIG. 7 is a diagram showing examples of time compressive force paths X (t).

The advantages of this automatic control of the operating value are illustrated in FIG. 7, which shows various time compressive force distributions X(t). As explained above, the curve X5(t) according to the "REG" mode takes place in a narrow control range between an upper limit value XA=DX and a lower limit value XA−DX, with a control to a constant pressure.

Curve X6(t) shows the compressive force distribution if the displacement Y is kept constant. The influences or changes of Y by temperature, make-ready and paper thickness explained in connection with FIG. 6 give a corresponding, clear change in the resulting compressive force X6(t) when the displacement Y is kept constant. Up to now it has been necessary for the machine operator to constantly monitor these influences and periodically compensate them manually by tracking the displacement Y, which corresponds to the curve X7(t). This was very complicated and also imprecise, so that only one effectively resulting curve X7(t) with clearly varying compressive force values was obtained.

The resulting embossing or blocking quality is clearly better according to the new curve X5(t) with automatic constant control than with the previously attainable curve X7(t). In addition, operating errors can be avoided with the automatic functions and controls of the machine according to the invention.

Figure 8:
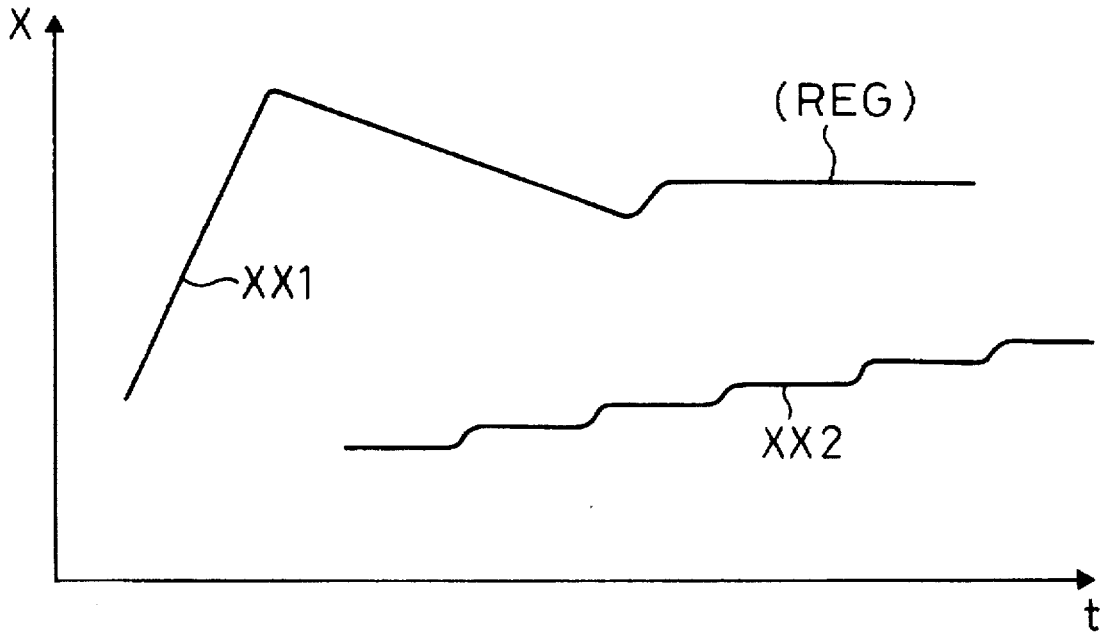
FIG. 8 is a diagram programmable desired value runs of the compressive force XX(t).

However, the resulting compressive force distribution X(t) cannot merely be automatically kept constant according to curve "REG", but in principle it is possible to control randomly predeterminable desired value distributions of the compressive force XX(t) by corresponding tracking of the displacement Y and FIG. 8 illustrates two examples of this. Curve XX1 shows a rapid rise, followed by a slow fall and then constant compressive force according to the "REG" mode. According to curve XX2 the compressive force is increased in steps, e.g. from X=600 kN in each case by 20 kN to 700 kN. Thus, e.g. for each step 20 identical trial proofs can be automatically produced with the machine. Thus, the best printing quality can be optically determined and the corresponding value can be chosen as the operating value XA.

By giving suitable desired values XX(t) or by controlled displacement functions Y(t) e.g. optimum parameters for characterizing embossing or blocking impressions can be determined automatically, more precisely and more comprehensively.

We claim:

1. An embossing and printing machine for embossing sheets comprising the combination of a press top (3) having a die block (9), a block plate (4), means for heating said block plate (4) and said block plate having a blocking surface (F) supporting blocks (8);

a mechanical positioning device (10) comprising a displacement drive for adjusting vertical positioning of said die block;

a press bottom (19) comprising a mechanical toggle press (17) carrying a make-ready plate and a make-ready (15) for supporting sheets during embossing, said toggle press being operative to lift said press bottom a predetermined distance to said press top;

a plurality of pressure sensors mounted around a center (Z) of said blocking surface (F) for sensing compressive forces (X) acting on said blocking surface and for producing outputs representative of said forces; and a machine control (2) including a motor control (21) for controlling operation of said positioning device, a pressure control (30) connected to receive outputs from said plurality of sensors for adjusting operating pressure to a predetermined optimum operating value (XA) by adjusting said positioning device to compensate for variations in displacement values (YO) due to compression of said make-ready (15) and heating during an embossing process, thereby precisely controlling pressure applied during embossing, and a display and control unit (40) for displaying operation of said machine control and for permitting manual operation thereof.

2. A machine according to claim 1 wherein said plurality of sensors comprises four sensors and wherein one of said sensors is mounted at each of four corners of said block plate.

3. A machine according to claim 1 and including a plurality of support members supporting said press top, and wherein said plurality of sensors comprise strain gauges, one said strain gauge being mounted on each said support member to detect strain therein.

4. A machine according to claim 1 wherein said positioning device comprises a first cam surface on said die block, a wedge with a second cam surface in contact with said first cam surface and a drive motor coupled to move said wedge to thereby position said die block.

5. A machine according to claim 1 wherein said pressure control includes a pressure control program having a plurality of operating modes selectable on said display and control unit.

6. A machine according to claim 5 wherein said pressure control program includes an operating mode for determining the dependence of said compressive force (X) as a function of displacement (Y) of said die block.

7. A machine according to claim 5 wherein said pressure control program comprises an operating mode wherein predetermined force values (XX(t)) or displacement values are automatically run.

8. A machine according to claim 5 wherein said pressure control program comprises preselectable pressure difference values (DX) and readjusting steps (DY) for controlling the compressive force value (X).

9. A machine according to claim 5 wherein said pressure control program comprises fixed safety values, (XM, XMi), limiting values and tolerance ranges (XT).

10. A machine according to claim 5 wherein said pressure control program comprises predetermined switching values (XT, DY) at which machine stop and warning signals are triggered.

11. A machine according to claim 1 wherein said pressure control (30) comprises a three-point control with a control difference (DX) and a displacement readjustment step (DY) and wherein an actual value is constantly calculated as a mean value (Xm) from a last n pressure measurements.

* * * * *